US006896567B1

(12) United States Patent
Esposito

(10) Patent No.: US 6,896,567 B1
(45) Date of Patent: May 24, 2005

(54) MARINE MOTOR COOLING SYSTEM FLUSHING APPARATUS AND METHOD

(76) Inventor: Philip T. Esposito, 7353 Curlew Rd., Sarasota, FL (US) 34241

( * ) Notice: Subject to any disclaimer, the term of this patent is extended or adjusted under 35 U.S.C. 154(b) by 0 days.

(21) Appl. No.: 10/368,279

(22) Filed: Feb. 18, 2003

(51) Int. Cl.[7] ..... B63H 21/10
(52) U.S. Cl. ..... 440/88 N; 134/167 R
(58) Field of Search ..... 440/88 R, 88 N, 440/113; 134/166 R, 167 R, 167 C, 171, 166 C

(56) References Cited

U.S. PATENT DOCUMENTS

| | | | | |
|---|---|---|---|---|
| 3,002,488 | A | | 10/1961 | Guhlin |
| 3,635,829 | A | | 1/1972 | Yang |
| 4,121,948 | A | | 10/1978 | Guhlin |
| 4,129,423 | A | | 12/1978 | Rubin |
| 4,362,639 | A | | 12/1982 | Eoga |
| 4,919,800 | A | | 4/1990 | Vinoski |
| 5,011,615 | A | | 4/1991 | Minderman |
| 5,063,896 | A | * | 11/1991 | Hyatt et al. ..... 123/198 A |
| 5,358,655 | A | | 10/1994 | Kruse et al. |
| 5,482,483 | A | | 1/1996 | Rice |
| 5,691,293 | A | | 11/1997 | Kruse et al. |
| 5,725,403 | A | | 3/1998 | Ridolfo |
| 5,746,629 | A | | 5/1998 | Smith |
| 5,775,964 | A | | 7/1998 | Clark |
| 5,823,836 | A | | 10/1998 | Anderson |
| 5,853,068 | A | * | 12/1998 | Dixon et al. ..... 184/1.5 |
| 5,855,219 | A | * | 1/1999 | Spencer ..... 134/167 R |
| 6,001,789 | A | | 12/1999 | Trinh et al. |
| 2003/0015554 | A1 | * | 1/2003 | Gatzke ..... 222/181.2 |

OTHER PUBLICATIONS

Milton J. Rosen,. Surfactants and Interfacial Phenomena, 2nd Ed. 1989, p. 375–376.*

* cited by examiner

*Primary Examiner*—Andrew Wright
(74) *Attorney, Agent, or Firm*—Price & Adams

(57) ABSTRACT

A compound is added to a device that flushes the cooling system of a marine motor. The device conveys liquid from a source to the marine motor. The liquid is mixed with a compound to form a flushing solution. The compound in solution performs three functions: removing contaminants from the cooling system, reducing corrosion in the cooling system, and coloring the solution for a period of time that corresponds to the period of time that is necessary to complete the flushing operation.

27 Claims, 3 Drawing Sheets

MARINE MOTOR COOLING SYSTEM FLUSHING APPARATUS AND METHOD

BACKGROUND OF THE INVENTION

1. Field of the Invention

This invention relates to method and apparatus for removing contaminants from a cooling system in a marine motor and, more particularly, to a method and apparatus for mixing and conveying a colored cleaning solution for removing dirt, oil, and potentially corrosive contaminants in a marine motor.

2. Description of the Prior Art

Marine motors are commonly used in salt or brackish water. The cooling system of marine motors can be contaminated with salt, dirt, oil, etc. from the water. Henceforth, the cooling system must be repeatedly cleaned. Dirt, sand, silt, and oil can build up and clog the cooling system of marine motors. In addition, salts and acids can corrode the cooling system of marine motors. As a result, flushing of the cooling system should be part of the regular maintenance of a motor and can extend the useful its life.

Several devices have been suggested to convey a flushing liquid to a marine motor from a source. U.S. Pat. No. 3,002,488 discloses a flushing device having a tubular conduit for receiving fluid from a garden hose and for providing fluid to a motor. The flushing device does not include a mixing chamber, which can be used to mix compounds with water to form specially designed flushing fluids.

U.S. Pat. No. 5,482,483 discloses a portable reservoir for flushing a motor. The reservoir has a tubular member connected to its outlet end for attachment to a garden hose through a shut-off valve. The reservoir uses gravity to supply flushing fluid to the motor.

U.S. Pat. No. 4,919,800 discloses a flushing system for a liquid-cooled, internal combustion marine engine for flushing the engine. The flushing system includes a novel coolant strainer. The flushing system conveys flushing solution through the strainer and through a hose to the cooling system.

U.S. Pat. No. 5,725,403 discloses a method for flushing a motor using an open trough for receiving and transferring flushing fluid. The open trough accommodates a marine motor propeller. The use of organic detergent as a component of a flushing solution is disclosed, but the addition of a coloring agent or dye to indicate the completion of the flushing process is not suggested.

U.S. Pat. No. 5,775,964 discloses a dual-tube fluid mixing conduit for conveying fluid from a source to an outlet. The conduit includes a delivery tube connected in parallel with a mixing tube. The mixing tube is in fluid communication with the delivery tube and can mix components of a solution before conveying the solution to the outlet.

U.S. Pat. No. 4,121,948 discloses an apparatus for flushing the cooling system of a boat motor. The apparatus includes a specially designed pad and tubular connector for conveying flushing fluid. One end of the tubular connector connects to the pad. The second end of the tubular connector is V-shaped and has two legs. A first leg connects to a flushing fluid source to form a flow path from a fluid source to the cooling system. A second leg releasably connects to a container. The tubular connector has an actuator-aperture-valve system to allow fluid communication between the container and the flow path of the connector.

U.S. Pat. No. 5,823,836 patent discloses a similar connector to the connector disclosed in U.S. Pat. No. 4,121,948. The connector has a first end for connecting to a marine motor and a V-shaped second end. The V-shaped second end includes a leg for receiving fluid from a fluid source and a leg releasably attached to a container. The container is a disposable bottle, which contains lubricating fluid. The system allows the simultaneous lubrication and flushing of the cooling system of a marine motor.

U.S. Pat. No. 5,746,629 patent discloses a device for flushing a cooling system. The device includes a reservoir and a T-shaped member. The T-shaped member connects to the reservoir, a inlet for receiving water, and a outlet for conveying flushing solution. The T-shaped member also includes a valve that can be closed to prevent flow from the inlet to the outlet. The valve allows the reservoir to fill with water for mixing to form the flushing solution. The flushing solution can include baking soda or other commercially available fluids designed to prevent corrosion.

U.S. Pat. No. 5,011,615 discloses a collar that attaches to an outboard motor. The collar holds a biocide-containing tablet in a cavity. The cavity is positioned close to cooling water inlets, which are part of an outboard motor cooling system. The biocide flows from the cavity into the inlets.

Several detergents that include baking soda and washing soda have been suggested. U.S. Pat. No. 4,362,639, U.S. Pat. No. 6,001,789, and U.S. Pat. No. 3,635,829 disclose commercial detergent compositions. Milton J. Rosen, *Surfactants and Interfacial Phenomena*, second edition, John Wiley and Sons, 1989, p. 375–376, also discloses commercial detergent compositions. The compositions include surfactants, builders, and dyestuffs. Builders include baking soda, washing soda, and other carbonates.

U.S. Pat. No. 4,129,423 discloses a composition for removing the discoloration of hard surfaces. The composition includes 1–20% detergent (surfactant), fillers, and coloring agents. The list of possible fillers includes sodium bicarbonate.

U.S. Pat. Nos. 5,358,655 and 5,691,293 disclose the inclusion of detergents in tablets. The tablets are used in dishwashing machines.

While there are many known commercial detergent compositions, most known commercial detergents are produced for general use or for specific applications that do not include flushing solutions for marine motors. In addition, the known flushing solutions for marine motors do not include dyestuffs or other color indicators that indicate when a flushing operation is complete. Therefore, there is a need for a compound that forms colored water, which can be passed through a marine motor cooling system and can flow through the cooling system until the water becomes clear.

SUMMARY OF THE INVENTION

In accordance with the present invention there is provided an apparatus for removing contaminants from a cooling system in a marine motor that includes: a compound for flushing a cooling system in which the compound has a first component for cleaning the cooling system. A second component reduces corrosion in the cooling system. A third component provides water coloring. A conveying device transports water from a source to the cooling system. The conveying device includes a mixing chamber and a conduit portion. The mixing chamber is connected to the water source for mixing water with the compound to color the water in the chamber and direct the colored water to the conduit portion. The conduit portion conveys the colored water from the chamber to the cooling system for flushing the cooling system until a sufficient amount of the colored water from the mixing chamber has passed through the cooling system and water flow from the cooling system is clear indicating that the flushing operation is complete.

Further in accordance with the present invention, there is provided an apparatus for flushing a cooling system of a marine motor that includes: a chemical delivery system with a compound having an neutralizer for reducing corrosion in the cooling system. A detergent cleans the cooling system. A colorant is provided for coloring water to flush the cooling system. A flushing system includes an attachment having a connector for receiving water from a water source. A mixing chamber is releasably secured to the connector for mixing water with the compound to form a flushing solution. A conduit is connected to the mixing chamber at one end and to the cooling system at an opposite end for delivering the flushing solution to the cooling system.

Further in accordance with the present invention, there is provided a method for flushing a cooling system of a motor that includes the steps of conveying a coolant from a coolant source through a conveying device to an input of the cooling system. A predetermined amount of neutralizer is mixed with the coolant in the conveying device. A predetermined amount of cleaner is mixed with the coolant in the conveying device. A predetermined amount of coloring agent is added to the coolant to change the color of the coolant from an initial color to an indicating color. The coolant is conveyed to the cooling system. A volume of the coolant is conveyed through the cooling system until the color of the coolant changes from the indicating color to the initial color.

Further in accordance with the present invention, there is provided an apparatus for flushing a cooling system in a marine motor that includes a compound for flushing a cooling system. The compound has a first component for cleaning the cooling system. A second component reduces corrosion in the cooling system. A third component is provided for coloring water. Means is provided for mixing the compound with water to form a flushing solution. Means is provided for conveying the flushing solution to the cooling system. The means for conveying the flushing solution receives flushing solution from the means for mixing the compound with water. The means for conveying the flushing solution conveys the flushing solution until the concentration of the third component of the compound has fallen below a predetermined level in the flushing solution and the color of the flushing solution is clear.

Accordingly, a principal object of the present invention is to provide an apparatus and method for flushing the cooling system of a marine motor.

Another object of the present invention is to provide a flushing solution for a marine motor cooling system that includes a cleaning component, an anti-corrosive component, and a coloring agent.

A further object of the present invention is to provide a flushing solution for using in a flushing operation for a marine motor cooling system that includes a sufficient quantity of a colorant to color the flushing solution until the flushing operation is complete.

An additional object of the present invention is to provide a flushing solution for using in a flushing operation for a marine motor cooling system that includes a sufficient quantity of a colorant to color the flushing solution until a predetermined quantity of a detergent has passed through the cooling system.

An additional object of the present invention is to provide a flushing solution for using in a flushing operation for a marine motor cooling system that includes a sufficient quantity of a colorant to color the flushing solution until a predetermined quantity of a neutralizer has passed through the cooling system.

These and other objects of the present invention will be more completely described and disclosed in the following specification, accompanying drawings, and appended claims.

DESCRIPTION OF THE PREFERRED EMBODIMENTS

Figure 1:
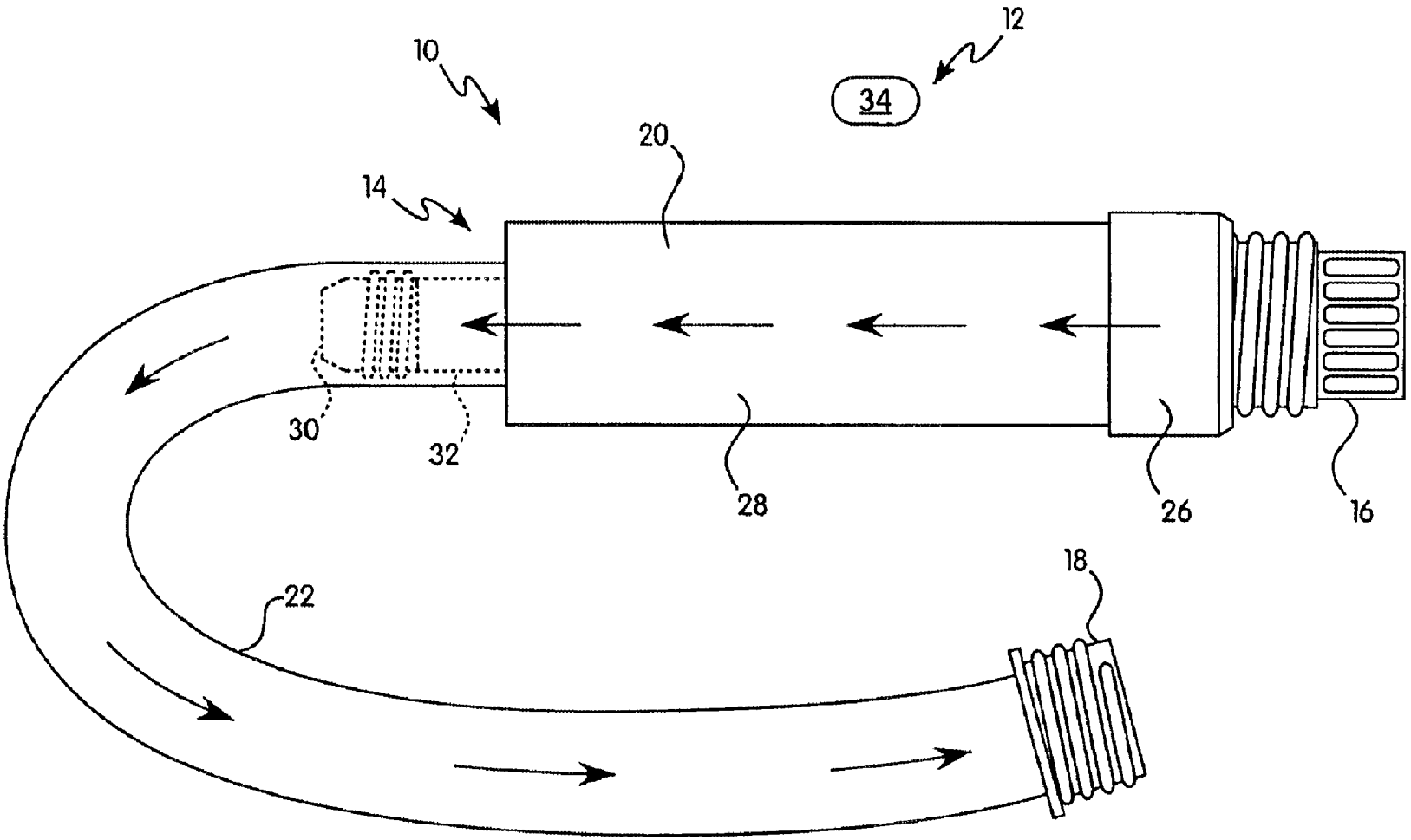
FIG. 1 is a view in side elevation of an apparatus for removing contaminants from a cooling system of a marine motor.

Referring to the drawings and particular to FIG. 1, there is illustrated an apparatus generally designated by the numeral 10 for removing contaminants from a cooling system in a marine motor. The apparatus 10 includes a compound 12 and a conveying device generally designated by the numeral 14. The conveying device 14 includes a first connector 16 for receiving water from a water source (not shown) and a second connector 18 for providing a solution to a cooling system in a marine motor (not shown).

The conveying device 14 also receives the compound 12 and combines the compound 12 with water to form a solution for flushing the cooling system. The flushing solution includes three components that perform three different functions. The first component cleans the cooling system by removing oil, dirt, sand, silt or other substances from the cooling system. The second component reduces corrosion in the cooling system by neutralizing and/or removing corrosion-causing substances, such as acids, certain salts or other substances that form corrosion-causing ions in solution. The third component colors the flushing solution and can indicate whether the first component or the second component are present in the flushing solution.

The color of the flushing solution indicates whether the flushing operation has begun, is in process, or has ended. The flushing solution changes from its original color to a predetermined color when the compound 12 is mixed with water or another incoming liquid to form the flushing solution. The flushing solution changes from the predetermined color to its original color after the concentration of third component of the flushing solution falls below a predetermined level.

The flushing solution is colored for a period of time corresponding to the period of time between the initial mixing of the flushing solution to time when the third component has fallen below a predetermined level. The period of time can be adjusted by changing the original amount of the third component in the compound 12. In one embodiment, the concentration of the third component will fall below a predetermined level when a sufficient volume of the flushing solution has passed through the cooling system to flush the cooling system. In another embodiment, the initial concentration of the third component is selected to allow the third component to color the flushing solution for a predetermined time period.

The initial concentration of the third component can be selected to allow the concentration of the third component to fall below the predetermined level when a predetermined amount of the first component or the second component have passed through the cooling system. In one embodiment, the initial amount of the third component in the compound is proportional to the initial amount of the first component, such that the third component colors the flushing solution until a predetermined quantity of said first component has passed through the cooling system. In another embodiment, the initial amount of the third component in the compound is proportional to the initial amount of the second component, such that the third component colors the flushing solution until a predetermined quantity of said second component has passed through the cooling system.

As shown in FIG. 1, the conveying device 14 includes a mixing chamber 20 for mixing the flushing solution. The mixing chamber 20 receives the compound 12 and combines the compound 12 with water or any suitable incoming solution to form the flushing solution. In the preferred embodiment, the mixing chamber 20 does not include any dynamic mixing aids to enhance the mixing the compound 12 with water. However, dynamic mixing aids, such as mechanical or electrical stirring devices, can be added if desired.

As illustrated in FIG. 1, the conduit 22 communicates with the mixing chamber 20 to convey the flushing solution to the cooling system of the marine motor. The conduit 22 is tubular and can be made from any suitable clear material. The term "clear" material includes all transparent or translucent materials. The conduit 22 can be flexible or rigid. In a preferred embodiment, the conduit is made from a flexible, clear plastic, which facilitates the visual observation of the color of the flushing solution. The conduit 22 can also be made from an opaque plastic having one or more clear plastic portions or windows. When at least a portion of conduit 22 is clear, the initial amount of the third component will cause the color of the flushing solution to change from the predetermined color to its original color until a predetermined volume of flushing solution has passed through the conduit 22.

As shown in FIG. 1, the mixing chamber 20 includes an opening 24 for receiving the first, second, and third components of the compound 12. The mixing chamber 20 also includes a top portion 26 and a bottom portion 28. The top 26 cooperates with the first connector 16 and receives water from the connector 16. The bottom portion 28 connects to the conduit 22. From the bottom portion 28 flushing solution is conveyed through outlet 30 into conduit 22 to the second connector 18. In the preferred embodiment, the top portion 26 is connected to the bottom portion 28 with a threaded connection. The top portion 26 separates from the bottom portion 28 to allow the compound 14 to be placed into the bottom portion 28.

As shown in FIG. 1, the conduit 22 communicates with the mixing chamber 20 through outlet 30. The outlet 30 communicates with the mixing chamber 20 through an intermediate connector 32. The intermediate connector 32 has a diameter smaller than the diameter of the mixing chamber 20 to receive the conduit 22 thereon. The intermediate connector 32 also has a diameter that is larger than the diameter of the outlet 30. Accordingly, outlet 30, the intermediate connector 32, and the mixing chamber 20 form a funnel for conveying fluid from the mixing chamber 20 to the conduit 22 at a predetermined rate to provide sufficient mixing of the compound 12 and water.

Figure 2:
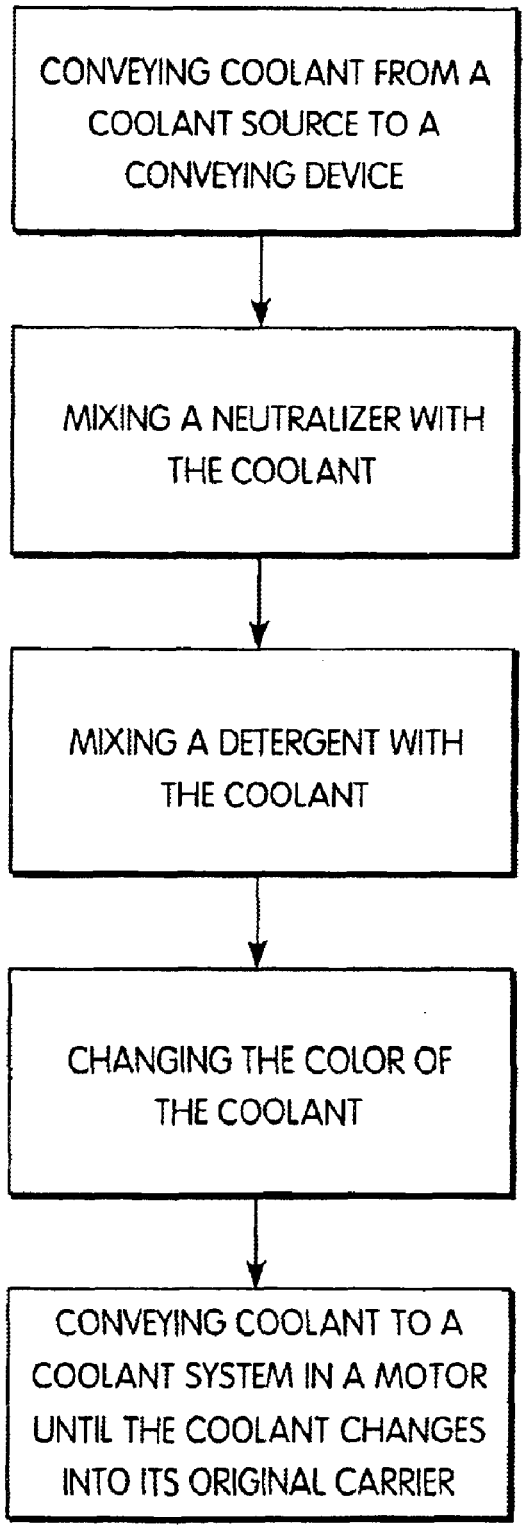
FIG. 2 is a flow chart of a method of the present invention.
Figure 3:
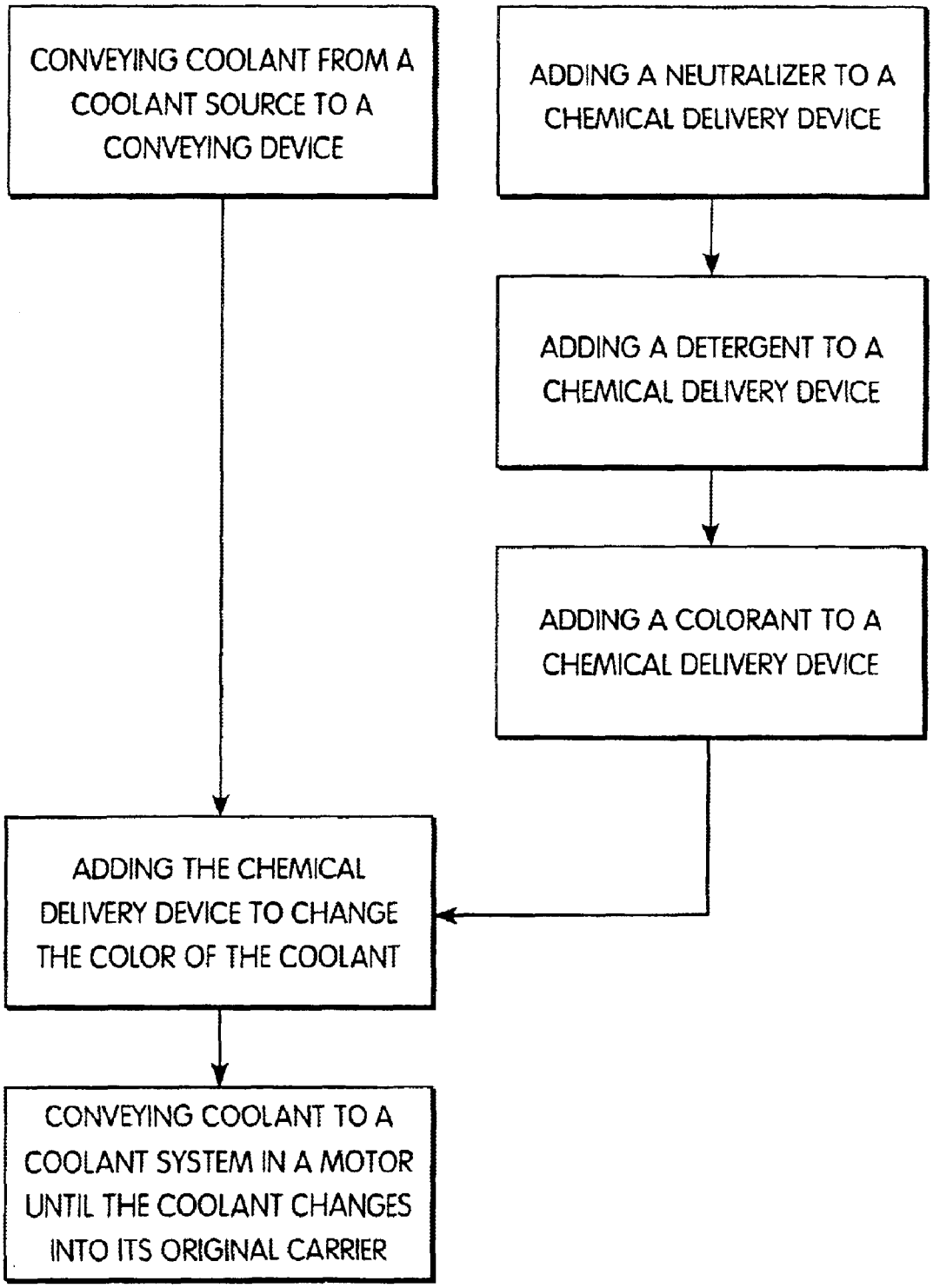
FIG. 3 is a flow chart of another method of the present invention.

Referring now to FIGS. 2–3, the compound 12 can be mixed with water in the mixing chamber 20. The first, second, and third components of compound 12 can be mixed before or after they are placed in the mixing chamber 20. The components can be delivered through a common delivery device 34, such as a tablet, pill, or a container. The delivery device 34 can also be a solution in which one or more of the components of the compound 12 have been mixed before being added to the conveying device 14. The solution can be aqueous or non-aqueous.

The first component of the compound 12 facilitates the removal of foreign material such as oil, dirt, grease, sand, silt, or other similar substances from the cooling system. The first component cleans the cooling system by decreasing the surface tension between the flushing solution and the foreign material. The foreign material mixes with flushing solution to be conveyed out of the cooling system. Accordingly, the first component is a detergent that includes at least one surfactant or surface-active agent. The surfactant is selected from a group consisting of an anionic surfactant, cationic surfactant, zwitterionic surfactant, or non-ionic surfactant.

The second component of the compound 12 prevents foreign material from corroding the cooling system. The second component prevents the corrosion of the cooling system through any suitable corrosion prevention or reduction mechanism. Corrosion prevention or reduction mechanisms include, but are not limited to, reducing the concentration of electrolyte in solution in the cooling system, neutralizing acid in the cooling system, stabilizing the pH of solutions that pass through the cooling system, coating the interior surfaces of the cooling system with a corrosion resistant barrier, or adding an inhibitor to inhibit the corrosion mechanism that is causing the corrosion of the cooling system.

Accordingly, the second component of the compound 12 is an anti-corrosive material. In the preferred embodiment, the corrosion prevention or reduction mechanism is neutralization. The anti-corrosive material is a neutralizer. In the most preferred embodiment, the neutralizer is a sodium carbonate compound. Sodium carbonate compounds include, but are not limited to baking soda and washing soda.

The third component of compound 12 includes a coloring agent for coloring the flushing solution. The particular color of the coloring agent is not critical. However, the difference in appearance between the incoming solution and the flushing solution must be sufficient to determine whether the concentration of coloring agent in the flushing solution is above a critical level. The critical level is a predetermined concentration level of the coloring agent that corresponds to the completion of the flushing process. In the preferred embodiment, the coloring agent is a dye.

In a preferred embodiment, the compound 12 is packaged in tablet form in a kit with the conveying device 14. In one embodiment the compound 12 includes between about 0.5 to 10% by weight detergent, between about 80 to 99% by weight baking soda, and up to about 10% by weight dye. The tablet 12 is formed of the following constituents by weight: 55% sodium bicarbonate, 25% sodium carbonate, 15% citric acid, 2% surfactant, 2% sodium silicate, and 0.5% FD & C Blue #1 (dye).

Referring now to FIGS. 2–3, the first step of the flushing operation includes conveying coolant from a coolant source through a conveying device 14 to an input of the cooling system. The incoming coolant is used to make flushing solution can be water, another liquid, or a solution. The coolant is produced by mixing the compound 12 with the incoming coolant to form a flushing solution.

In forming the flushing solution, a predetermined amount of neutralizer is mixed with the coolant in the mixing chamber 20 of the conveying device 14. A predetermined amount of cleaner is mixed with the coolant in the mixing chamber 20 of the conveying device 14. A predetermined amount of coloring agent is added to the coolant in the mixing chamber 20 of the conveying device 14 to change the color of the coolant from an initial color to a color that indicates that the compound 12 is in solution with the coolant to form the flushing solution.

The flushing operation is monitored through visual inspection of the coolant that passes through the conveying device 14. In one embodiment of the invention, the coolant that passes through the cooling system is inspected to determine when the flushing operation has been completed. In another embodiment of the invention, coolant is conveyed through a transparent portion of the conduit 22 of the conveying device 14 and visually inspected.

The appearance of the coolant due to the concentration of coloring agent in the coolant is used to determine when a predetermined quantity of the coolant has passed through the cooling system. The flushing operation must be continued until a sufficient quantity of neutralizer and cleaner has passed through the cooling system.

In one embodiment of the invention, the flushing operation is complete after a predetermined volume of coolant has passed through the coolant system. The concentration of coloring agent remains above a predetermined level until a volume of the coolant has been conveyed through the cooling system and the color of the coolant changes from a predetermined color to its initial color.

In another embodiment of the invention, the flushing operation is complete after a predetermined amount of neutralizer has been conveyed through the cooling system. The concentration of coloring agent remains above a predetermined level until a predetermined amount of neutralizer has been conveyed through the coolant system and the coolant has changed from the predetermined color to its initial color.

In another embodiment of the invention, the flushing operation is complete after a predetermined amount of cleaner has been conveyed through the cooling system. The concentration of coloring agent remains above a predetermined level until a predetermined amount of the cleaner has passed through the cooling system and the coolant has changed from a predetermined color it its initial color.

According to the provisions of the patent statutes, I have explained the principle, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for removing contaminants comprising:

a marine motor having a cooling system, a compound for flushing said cooling system, said compound having a first component for cleaning said cooling system, a second component for reducing corrosion in said cooling system, and a third component for coloring water, a conveying device for transporting water from a source to said cooling system, said conveying device including a mixing chamber and a conduit portion, said mixing chamber connected to the water source for mixing water with said compound to color the water in said chamber and direct the colored water to said conduit portion, said conduit portion attached to said marine motor cooling system so that said cooling system can receive the colored water from said mixing chamber, and said conduit portion conveying the colored water from said chamber to said cooling system for flushing said cooling system until a sufficient amount of the colored water from the mixing chamber has passed through said cooling system and water flow from said cooling system is clear indicating that the flushing operation is complete.

2. Apparatus for removing contaminants as set forth in claim 1 in which:

said compound includes a predetermined amount of said third component sufficient to color the water for a preselected time period.

3. Apparatus for removing contaminants as set forth in claim 1 in which:

said compound includes a sufficient amount of said third component to color the water until a predetermined volume of the colored water has flushed the cooling system to indicate that the flushing operation is complete.

4. Apparatus for removing contaminants as set forth in claim 1 in which:

said compound includes a sufficient amount of said third component to color the water until a predetermined quantity of said first component has passed through the cooling system.

5. Apparatus for removing contaminants as set forth in claim 1 in which:

said compound includes a sufficient amount of said third component to color the water until a predetermined quantity of said second component has passed through the cooling system.

6. Apparatus for removing contaminants as set forth in claim 1 in which:

said first component includes a detergent.

7. Apparatus for removing contaminants as set forth in claim 1 in which:

said second component includes a compound selected from the group consisting of baking soda and washing soda.

8. Apparatus for removing contaminants as set forth in claim 7 in which:

said first component includes a detergent.

9. Apparatus for removing contaminants as set forth in claim 1 in which:

said third component includes a dye.

10. Apparatus for removing contaminants as set forth in claim 1 in which:

said first component includes between about 0.5 to 10% by weight detergent, said second component includes between about 80 to 99% by weight baking soda, and said third component includes up to about 10% by weight dye.

11. Apparatus for removing contaminants as set forth in claim 1 in which:

said mixing chamber includes a top and a bottom, said top includes a connector for connecting the water source to said mixing chamber, and said top separating from said bottom to allow the compound to be placed in said mixing chamber.

12. Apparatus for removing contaminants as set forth in claim 1 in which:

said conduit portion includes a flexible hose.

13. Apparatus for removing contaminants as set forth in claim 1 in which:

said mixing chamber includes an outlet having a diameter smaller than the diameter of said mixing chamber and having a diameter larger than the diameter of said conduit to form a funnel for conveying fluid from said mixing chamber to said conduit at a predetermined rate to provide sufficient mixing of said compound and water.

14. An apparatus for flushing a marine motor comprising:

a marine motor cooling system, a chemical delivery system including a compound having a neutralizer for reducing corrosion in said cooling system, a detergent for cleaning said cooling system, and a colorant for coloring water to flush said cooling system, and a flushing system including an attachment having a connector for receiving water from a water source, a mixing chamber releasably secured to said connector for mixing water with said compound to form a flushing solution, and a conduit connected to said mixing chamber at one end and to said cooling system at an opposite end for delivering the flushing solution to said cooling system.

15. An apparatus for flushing a marine motor as set forth in claim 14 in which:

said chemical delivery system includes a tablet containing said neutralizer, said detergent, and said colorant.

16. An apparatus for flushing a marine motor as set forth in claim 15 in which:

said tablet contains a predetermined amount of said colorant sufficient to color the flushing solution in said mixing chamber.

17. An apparatus for flushing a marine motor as set forth in claim 14 in which:

a preselected volume of said flushing solution passes through the cooling system until the flushing operation is completed as indicated by a change in the color of the flushing solution from the cooling system.

18. An apparatus for flushing a marine motor as set forth in claim 15 in which:

said tablet includes a predetermined amount of said colorant to color the flushing solution to indicate that a predetermined quantity of said neutralizer has passed through the cooling system.

19. An apparatus for flushing a marine motor as set forth in claim 14 in which:

said neutralizer includes a tablet containing a compound selected from the group consisting of baking soda and washing soda.

20. An apparatus for flushing a marine motor as set forth in claim 14 in which:

said colorant includes a dye.

21. An apparatus for flushing a marine motor as set forth in claim 14 in which:

said compound includes between about 0.5% to 10% by weight said detergent, said neutralizer includes between about 80% to about 99% by weight baking soda, and said colorant including up to about 10% by weight dye.

22. A method for flushing a marine motor comprising the steps of:

conveying a coolant from a coolant source through a conveying device to an input of a marine motor cooling system, mixing a predetermined amount of neutralizer with the coolant in the conveying device, mixing a predetermined amount of cleaner with the coolant in the conveying device, adding a predetermined amount of coloring agent to the coolant to change the color of the coolant from an initial color to an indicating color, conveying the coolant to the marine motor cooling system, and conveying a volume of the coolant through the marine motor cooling system until the color of the coolant changes from the indicating color to the initial color.

23. A method as set forth in claim 22 which includes:

conveying a predetermined amount of neutralizer through the cooling system before the coolant changes from the indicating color to the initial color.

24. A method as set forth in claim 22 which includes:

conveying a predetermined amount of cleaner through the cooling system before the coolant changes from the indicating color to the initial color.

25. A method as set forth in claim 22 which includes:

conveying the coolant from the conveying device through a transparent conduit to the cooling system to indicate when a predetermined quantity of the coolant containing the coloring agent has passed through the cooling system.

26. A method as set forth in claim 22 which further includes the step of:

mixing the neutralizer, the cleaner, and the coloring agent with the coolant in a mixing chamber before conveying the coolant through the conveying device to the cooling system.

27. Apparatus for flushing a marine motor comprising:

a marine motor cooling system, a compound for flushing said cooling system, said compound having a first component for cleaning said cooling system, a second component for reducing corrosion in said cooling system, and third component for coloring water, means for mixing said compound with water to form a flushing solution, means for conveying said flushing solution to said cooling system, said means for conveying receiving flushing solution from said means for mixing, and said means for conveying supplying flushing solution until the concentration of said third component of said compound has fallen below a predetermined level in said flushing solution and the color of said flushing solution is clear.

* * * * *